US008066176B2

(12) United States Patent
Nielsen

(10) Patent No.: US 8,066,176 B2
(45) Date of Patent: Nov. 29, 2011

(54) FOLDABLE CONTAINER HAVING A FOUR-SIDED PLANE BASE

(76) Inventor: Elsebeth Bjerg Nielsen, Frederikssund (DK)

( * ) Notice: Subject to any disclaimer, the term of this patent is extended or adjusted under 35 U.S.C. 154(b) by 100 days.

(21) Appl. No.: 12/434,468

(22) Filed: May 1, 2009

(65) Prior Publication Data

US 2009/0261151 A1 Oct. 22, 2009

Related U.S. Application Data

(63) Continuation-in-part of application No. PCT/DK2007/000453, filed on Oct. 24, 2007.

(51) Int. Cl.
*B65D 5/36* (2006.01)
*B65D 5/468* (2006.01)

(52) U.S. Cl. ..... 229/117.07; 229/117.16; 229/186; 229/920; 229/931

(58) Field of Classification Search ..... 229/117.07, 229/117.08, 117.16, 186, 920, 931
See application file for complete search history.

(56) References Cited

U.S. PATENT DOCUMENTS

| | | | | |
|---|---|---|---|---|
| 898,577 | A * | 9/1908 | Harden | 229/117.07 |
| 899,654 | A * | 9/1908 | Bloomer | 229/117.07 |
| 938,406 | A * | 10/1909 | Zell | 229/117.08 |
| 1,148,219 | A * | 7/1915 | Cornell | 229/117.08 |
| 2,143,588 | A * | 1/1939 | Wenzel | 229/117.16 |
| 2,698,709 | A * | 1/1955 | Neuman | 229/117.07 |
| 2,942,726 | A * | 6/1960 | Marsh | 229/186 |
| 3,367,555 | A * | 2/1968 | Montgomery | 229/186 |
| 5,118,034 | A | 6/1992 | Tsao | |
| 5,253,802 | A * | 10/1993 | Bernard et al. | 229/117.08 |
| 6,676,010 | B1 * | 1/2004 | Roseth et al. | 229/186 |

FOREIGN PATENT DOCUMENTS

| | | | |
|---|---|---|---|
| EP | 1132303 | A | 9/2001 |
| GB | 295099 | A | 8/1928 |
| GB | 744337 | A | 2/1956 |
| GB | 2398558 | A | 8/2004 |
| GB | 2404181 | A | 1/2005 |
| GB | 2415956 | A | 1/2006 |

OTHER PUBLICATIONS

International Search Report.

* cited by examiner

*Primary Examiner* — Gary Elkins
(74) *Attorney, Agent, or Firm* — William J. Sapone; Coleman Sudol Sapone P.C.

(57) ABSTRACT

When according to the invention, a container is formed from a sheet-shaped material, and it is punched and scored such that the base (7) and the side members (3, 4, 5, 6) constitute an entity without incisions, cuts and the like, it is possible to achieve a container which is foldable, in that the side members may be folded inwards over the base, and which may be erected to provide a container which, when made of a combustible material, may be disposed of by incineration after use. As the container is completely liquid-tight, it may be used for liquid as well as solid contents.

6 Claims, 4 Drawing Sheets

FOLDABLE CONTAINER HAVING A FOUR-SIDED PLANE BASE

CROSS REFERENCE TO RELATED APPLICATIONS

This application is a continuation in part of PCT International Application no. PCT/DK2007/000453, filed Oct. 24, 2007.

The invention relates to a foldable container, such as a bowl or a dish, made of a preferably liquid-tight sheet-shaped material, and having a four-sided plane base with side members, two opposed ones of which may be provided with grips.

THE PRIOR ART

Containers or dishes of various shapes are used for more or less permanent storage of various products, be it in liquid or in solid form.

When the containers are made of a liquid-tight material, liquid products may be stored without any risk of destruction of the material. If the container is made of a combustible material, it may be disposed of by incineration after use.

Hereby, containers, such as dishes or bowls, of this type may be used for the storage of food products, beverages, various surgical instruments, organs, cat litter, etc. in a simple and hygienic manner. And since they may be incinerated, this may take place with or without contents, as needed.

Foldable containers are known, but all of these are vitiated by the drawback that their material consumption is very high and that they are complicated to manufacture.

An example of such a container is known from the description of U.S. Publication No. 20040200890 A1. The basis of this container is a sheet having a rectangular base portion 21 and 22 and Having a double rim portion extending around it, the outermost one of which may be folded inwards over the base portion, while the innermost one of which constitutes the actual side members of the container, when this is in its erected position. As will appear from FIG. 4, the workpiece is provided with a large number of cut-outs, cuts and bending lines in order for the sheet to be bent and assembled by means of glue angular flaps inserted info slits.

GB 2415956 discloses a container formed on the basis of a blank 10 with fold lines such that the walls may be folded upwards from a polygonal base portion 11. Two opposite wail portions are formed with outwardly extending flap portions 26 capable of being folded inwardly over the wall 13 so as to form the handles of the container. In order to keep the handles together, the handle structure 27 is rotated about its connected edge and pushed through the handle holes.

This container may be unfolded to form a blank, and may be folded up to create a bag or container. The container may be stored in a flat condition as a blank, but in that condition it is not capable of Immediately being ready for use.

THE OBJECT OF THE INVENTION

It is the object of the invention to simplify the manufacture of a foldable container and to improve its properties of use, and this is achieved according to the invention by means of a container having two opposed side members that are provided with bending lines or score lines, which extend from the corners of the base member and out to the middle of the rim of the side members, and wherein the two side members are each folded around the two bending lines such that the corner members' two halves are folded and adhered to the side of the other side members.

In this surprisingly simple manner, the container may be shaped as a single layered bowl, as the side members directly constitute the sides of the container, which thus extend In an unbroken section together with the base, which, in addition to the saving of material, also ensures a liquid-tight container.

When the corner members are folded and adhered together by putting the two halves together and, in the put-together state, are folded and adhered inwards against either the outer side or the inner side of the side members, a ready-formed container is obtained which may be folded to form a flat container and may be unfolded so as to form the container ready for use.

The oblique bending lines are additionally provided from the corners of the base member and at an angle outwards on each corner member, it is ensured that, when folded, the corners form completely closed corners with sides in just one layer of material.

When the folded-together corner members are adhered together and these are adhered firmly to the exterior of the side members, it is ensured that the container is ready for use without further measures.

When the corner member is folded together and is engaged with either the outer side or the inner side of the side members provided with grips, a termination of the sides of the container is achieved with an expedient absorption of force when the container is lifted in the grips. The two side members provided with grips are capable of engaging each other when the container Is in its folded-together position.

Also, it Is expedient to configure the grips such that the grip of the one side member may engage the grip of the opposed side member, thus achieving locking of the side members in the folded-together position of the container.

When the corner members on the other side are fitted with cuts to form a free space for the grips of the side members, the corner members will extend In plane with the sides when the container is folded together.

When the triangular central portion of the side members is folded inwards over the base member and then the outermost parts as well as the side members with the grips are applied on top, a flat and compact folded-together container is achieved.

When the bending lines extending on the side members are angled, the finished container may be given a larger or smaller opening area at the top relative to the area of the base, which facilitates the use of the container in many cases.

BRIEF DESCRIPTION OF THE DRAWING

Examples of embodiments of the invention will be described more fully below with reference to the drawings, in which.

DESCRIPTION OF AN EXEMPLARY EMBODIMENT

Figure 1:
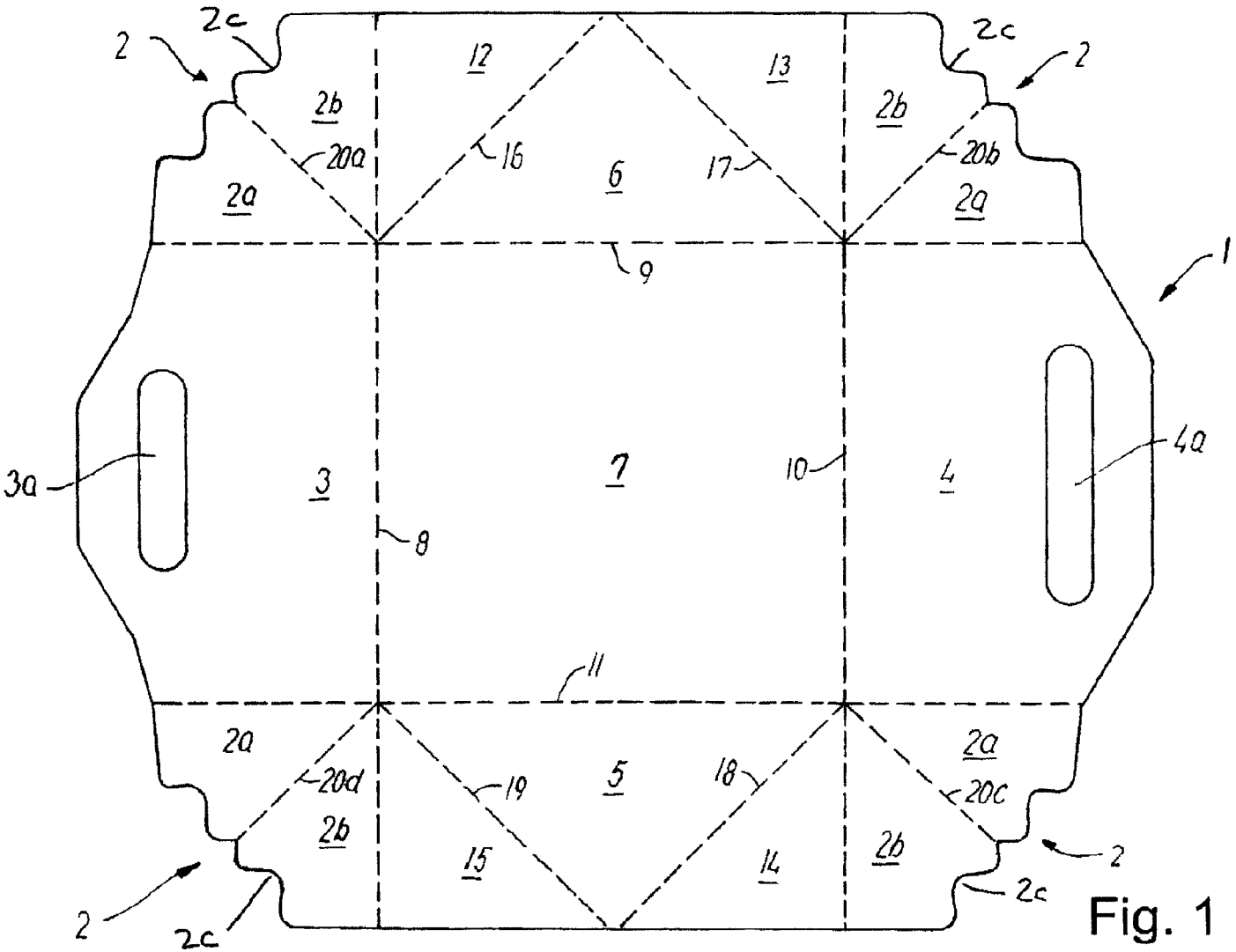
FIG. 1 shows an embodiment of the basic sheet for the making of the container.

The basis for the making of the foldable container according to the invention is a sheet-shaped piece of cardboard, plastics or other suitable material 1, as will appear from FIG. 1.

In the example shown, the sheet 1 Is shaped by punching to provide a container 1 with a square base 7, but, of course, the base may have an- other shape, e.g. rectangular.

The base 7 is defined by four bending lines or score lines designated 8, 9, 10 and 11, which extend along the side edge of the base in the entire extent of the sheet. Hereby, four side members designated 3, 4, 5 and 6 and four corner members designated 2 are provided.

In FIG. 1, the bending lines 8, 9, 10 and 11 are shown to be straight, whereby the finished container will have the same area at the top as at the base 7.

Figure 2:
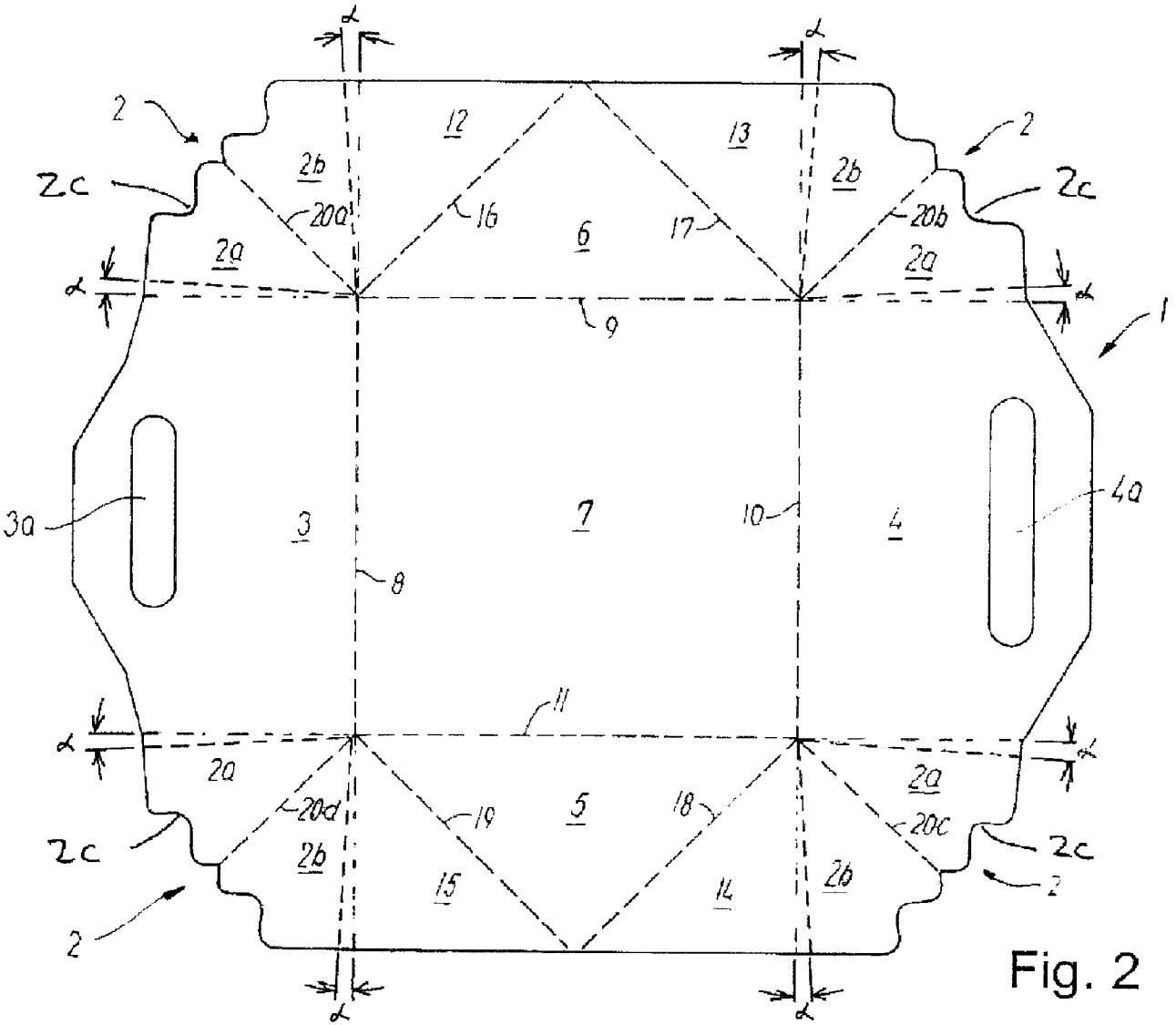
FIG. 2 shows a second embodiment of the basic sheet.

FIG. 2 shows another course of these bending lines as they extend at an angle $\alpha$ across the side members 3, 4, 5 and 6. Oblique side walls are formed hereby, where the opening area at the top is larger than the area of the base 7. By changing the angle $\alpha$, the inclination of the side members may be configured to provide e.g. a splash edge, a funnel shape or the like.

The bending lines are indicated in dashed lines in FIGS. 1 and 2, and it will be seen that the corner members 2 are provided with bending lines 20*a*, 20*b*, 20*c* and 20*d* from the corner of the base member 7 and out to the middle of the outer edge of the member 2 at an angle relative to the through-going bending lines 8, 9, 10 and 11.

Hereby, each corner member 2 forms two halves 2*a* and 2*b*.

The actual side members extend between the corner members 2, said side members being formed by two opposed members provided with grips and having cut-outs 3*a* and 4*a* to form the side members 3 and 4 as well as two opposed, rectangular side members 5 and 6.

These latter side members 5 and 6 are moreover provided with two bending lines each, 16 and 17 as well as 18 and 19, respectively, said bending lines extending from their respective base corner to the middle of the outer edge of the members 5 and 6, thereby forming two side members 12 and 13 as well as 14 and 15.

The sheet 1 thus punched and scored is thus ready to be bent and folded together to form the foldable container according to the invention, It is noted that no incision is present in the sheet, which will therefore constitute a complete, unbroken member and thus ensure a liquid-tight container.

Figure 3:
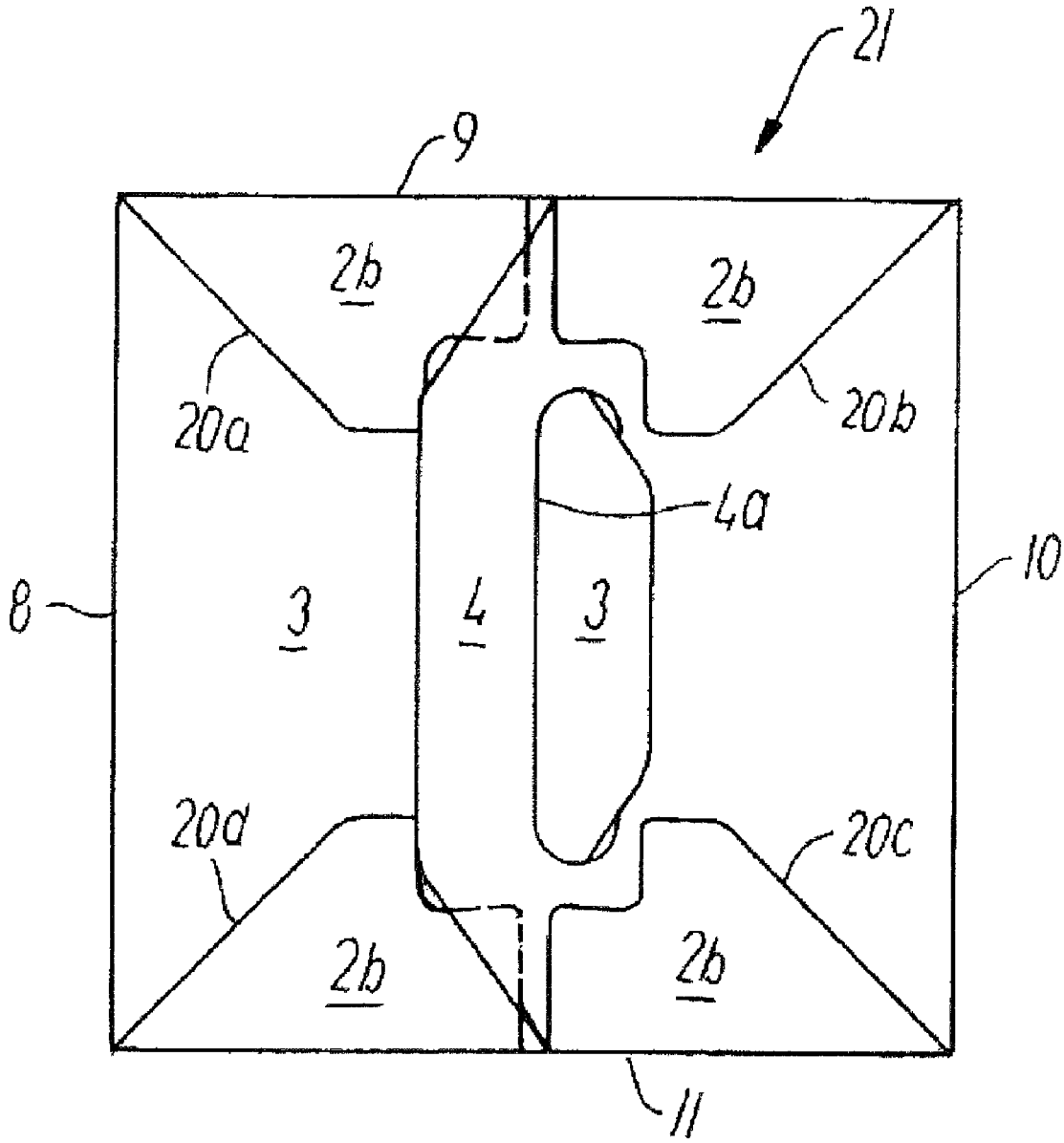
FIG. 3 shows the finished container in a folded-together and adhered position.

The sheet 1, as shown in FIGS. 1 and 2, may then be folded together to form the folded-together container shown in FIG. 3.

When the side members 3, 4, 5 and 6 are erected, four corners will be formed, whose parts 2*a* and 2*b* are adhered together to form a double-layered flap.

Figures 4, 5:
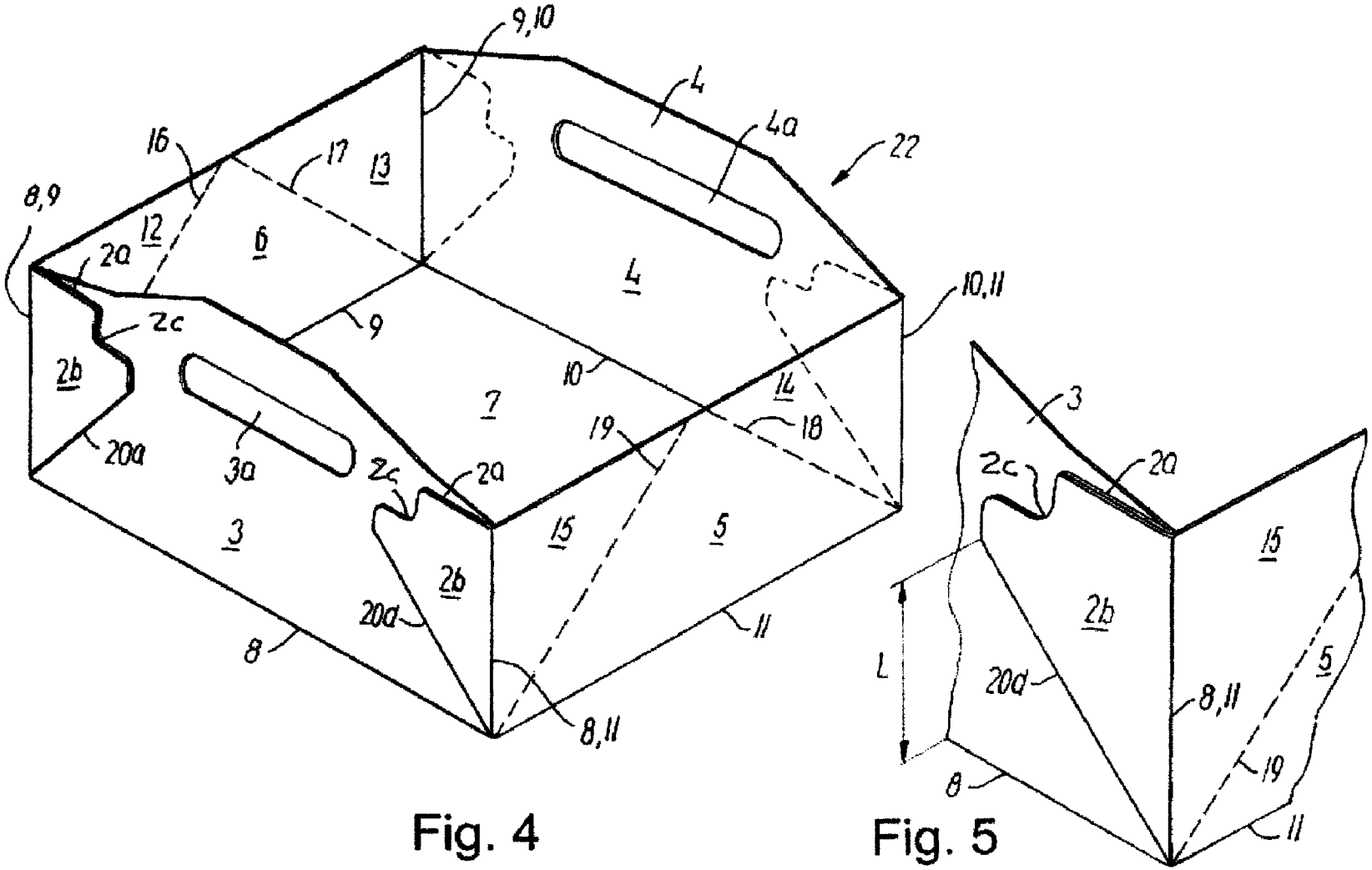
FIG. 4 shows the erected container, seen in perspective.
FIG. 5 shows a section of a corner, seen from the outside.

This flap is bent to engage the side members 3 and 4 provided with grips 3*a* and 4*a*, where they are adhered firmly to the outer side, as shown in FIGS. 4 and 5. The flaps may also be adhered to the inner side of the members 3 and 4, whereby the side members will extend completely flat on the outer side, and, in addition, the optimum liquid tightness of the container will be ensured.

Hereby, considerable stiffness and stability are imparted to the container, as the weight of the container will be absorbed and transferred via these strong corner reinforcements when the container is lifted in the grips.

The folding-together takes place in that the central portion of the side members 5 and 6 is first folded down to the base portion 7, as they will bend around the bending lines 16 and 17 as well as 18 and 19.

The outermost members 12 and 13 as well as 14 and 15 will then be folded downwards and simultaneously pull the side members 3 and 4 downwards too. Hereby, the entire container is folded together to a four-sided piece 21, as shown in FIG. 3.

As will be seen, the one grip 3 is in "locking" engagement with the cut-out 4*a* of the opposed grip 4, whereby the folded-together shape may be maintained.

As needed, the container may be packaged in a bag, and optionally be sterilized when the container is to be used for medicinal purposes.

A distance arrow L in FIG. 5 indicates the height at which, theoretically, liquid might leak from the container. But since the flaps 2*a* and 2 are adhered totally together and thus made liquid-tight, the container will be fully liquid-tight up to the upper side of the side members 5 and 6 under normal circumstances.

As shown in FIGS. 1 and 2, the outer edge of the corner members 2 is configured with three curved cut-outs to extend, after the folding-together, in an expedient manner externally on the side members 3 and 4 without interfering with the cut-outs 3*a* and 4*a* when the container is lifted and carried.

As mentioned, the container 1 may be made of a cardboard or plastics material, which may be made water-tight or is already water-tight, and which may be disposed of by incineration after use.

The invention claimed is:

1. A foldable container formable by folding a single sheet of a liquid tight material, the sheet comprising:

a centrally disposed four edged plane base surrounded by two opposed side members disposed on opposite sides of the plane base being provided with facing grips located therein, two non-grip side members disposed opposite to each other, four corner members defined between the grip side members and the non-grip side members, the four side members and four corner members being joined to each other to form a continuous, unbroken rim portion around the plane base, two first bending lines defining a folding joint between the grip side members and the plane base and two second bending lines provided substantially perpendicular to the first bending lines and crossing thereover for defining a folding joint between the non-grip side members and the plane base, the four corner members defined between the grip side members and the non-grip side members by portions of the four side member defining bending lines, each non-grip side member further being provided with two folding lines extending from a mid-point of an outer edge thereof to each junction between the crossing bending lines defining each non-grip side member, each corner member having a bending line bisecting the corner member to form two corner halves, the bisecting bending line extending from a junction between the crossing side member defining bending lines to a mid point of an outer edge of each corner member, such that the bisected corner members fold together to form flaps which fold over the grip side members to provide reinforcement therefore, the four side members being foldable to lay over the plane base for forming a flat four sided assembly, the bisected corner members being folded together to form flaps which lay beneath the grip containing side members when the flat four sided assembly is formed;

wherein the facing grips are capable of engaging each other; and, wherein the corner members have cut-out portions along the outer edge thereof for forming a free space sized for receiving the facing grips when the container is in a flat folded assembly and the facing grips are in engagement with each other.

2. The foldable container according to claim 1, wherein the folded flaps are adhered inwards against either an outer side or an inner side of the grip containing side members.

3. The foldable container according to claim 1, wherein at least one of the portions of the four side members defining bending lines extends at an angle (α) determined to increase a length of the outer edge of the adjacent side member relative to a length of an edge of the adjacent side member provided along the plane base.

4. A foldable container formable by folding a single sheet of a liquid tight material, the sheet comprising:

a centrally disposed four edged plane base surrounded by two opposed side members disposed on opposite sides of the plane base being provided with facing grips located therein, two non-grip side members disposed opposite to each other, four corner members defined between the grip side members and the non-grip side members, the four side members and four corner members being joined to each other to form a continuous, unbroken rim portion around the plane base, two first bending lines defining a folding joint between the grip side members and the plane base and two second bending lines provided substantially perpendicular to the first bending lines and crossing thereover for defining a folding joint between the non-grip side members and the plane base, the four corner members defined between the grip side members and the non-grip side members by portions of the four side member defining bending lines, each non-grip side member further being provided with two folding lines extending from a mid-point of an outer edge thereof to each junction between the crossing bending lines defining each non-grip side member, each corner member having a bending line bisecting the corner member to form two corner halves, the bisecting bending line extending from a junction between the crossing side member defining bending lines to a mid point of an outer edge of each corner member, such that the bisected corner members fold together to form flaps which fold over the grip side members to provide reinforcement therefore, the four side members being foldable to lay over the plane base for forming a flat four sided assembly, the bisected corner members being folded together to form flaps which lay beneath the grip containing side members when the flat four sided assembly is formed;

wherein the container is folded into the flat four sided assembly by folding the non-grip side members over the plane base, central portions of the two non-grip containing side members folded thereover and portions adjacent the central portions folded along the folding lines to lay over the central portion, the two grip containing side members being folded over the non-grip side members to complete the flat four sided assembly;

wherein the facing grips are capable of engaging each other; and, wherein the corner members have cut-out portions along the outer edge thereof for forming a free space for receiving the facing grips when the container is in a flat folded assembled and the facing grips are in engagement with each other.

5. The foldable container according to claim 4, wherein at least one of the portions of the four side member defining bending lines extends at an angle (α) determined to increase a length of the outer edge of the adjacent side member relative to a length of an edge of the adjacent side member provided along the plane base.

6. The foldable container according to claim 4, wherein the folded flaps are adhered inwards against either an outer side or an inner side of the grip containing side members.

* * * * *